US006932852B2

(12) United States Patent
Tayama et al.

(10) Patent No.: US 6,932,852 B2
(45) **Date of Patent: *Aug. 23, 2005**

(54) METHOD AND APPARATUS FOR ENHANCED PURIFICATION OF HIGH-PURITY METALS

(75) Inventors: Kishio Tayama, Akita (JP); Toshiaki Hodozuka, Akita (JP)

(73) Assignee: Dowa Mining Co., Ltd., Tokyo (JP)

( * ) Notice: Subject to any disclaimer, the term of this patent is extended or adjusted under 35 U.S.C. 154(b) by 111 days.

This patent is subject to a terminal disclaimer.

(21) Appl. No.: 10/613,545

(22) Filed: Jul. 2, 2003

(65) Prior Publication Data

US 2004/0083854 A1 May 6, 2004

Related U.S. Application Data

(63) Continuation-in-part of application No. 10/060,580, filed on Jan. 30, 2002, now abandoned.

(51) Int. Cl.[7] ..... C21C 7/10
(52) U.S. Cl. ..... 75/367; 266/208; 266/905
(58) Field of Search ..... 266/208, 905; 75/367, 407

(56) References Cited

U.S. PATENT DOCUMENTS

| | | | |
|---|---|---|---|
| 4,695,319 A | 9/1987 | Miura et al. | |
| 5,513,834 A | 5/1996 | Feldewerth et al. | |
| 6,805,833 B2 * | 10/2004 | Tayama et al. | 266/208 |

FOREIGN PATENT DOCUMENTS

| | | |
|---|---|---|
| EP | 0 047 665 A | 3/1982 |
| JP | 10-121163 A | 5/1998 |
| JP | 2001 221888 A | 8/2001 |
| SU | 1 010 148 A | 4/1983 |

OTHER PUBLICATIONS

Database WPI Section Ch, Derwent Publications Ltd., Abstract of SU 299 559 A (Dec. 1972).
*Perry's Chemical Engineering Handbook*, 5th Ed., Perry and Chilton McGraw–Hill, Dec. 1973, pp. 183 and 184.

* cited by examiner

*Primary Examiner*—Scott Kastler
(74) *Attorney, Agent, or Firm*—Frishauf, Holtz, Goodman & Chick, P.C.

(57) ABSTRACT

A 99.99% pure indium feed is charged into a crucible and heated to 1250 ° C. by an upper heater in a vacuum atmosphere at $1\times10^{-4}$ Torr, whereupon indium evaporates, condenses on the inner surfaces of an inner tube and drips to be recovered into a liquid reservoir in the lower part of a tubular member, whereas impurity elements having a lower vapor pressure than indium stay within the crucible. The recovered indium mass in the liquid reservoir is heated to 1100° C. by a lower heater and the resulting vapors of impurity elements having a higher vapor pressure than indium pass through diffuser plates in an upper part of the tubular member to be discharged from the system, whereas the indium vapor recondenses upon contact with the diffuser plates and returns to the liquid reservoir, yielding 99.9999% pure indium, while preventing the loss of indium.

16 Claims, 2 Drawing Sheets

METHOD AND APPARATUS FOR ENHANCED PURIFICATION OF HIGH-PURITY METALS

CROSS REFERENCE TO RELATED APPLICATION

This application is a continuation-in-part application of application Ser. No. 10/060,580 filed Jan. 30, 2002, now abandoned.

BACKGROUND OF THE INVENTION

1. Field of the Invention

This invention relates to an enhanced purification method by which a high-purity metallic indium feed with a purity of about 99.99% (4N) is further purified to give metallic indium with a purity of about 99.9999% (6N) or higher and which is also applicable for such enhanced purification of antimony, zinc, tellurium, magnesium, cadmium, bismuth and silver (which are hereunder referred to as "similar metals"). The invention also relates to an apparatus for purification that is used to implement the method.

2. Background Information

Indium is generally produced as a minor amount component of zinc concentrates, so in zinc metallurgy, it is recovered either as a flue cinder or as a concentrate obtained in an intermediate step such as an electrowinning of zinc. In recent years, indium is also recovered in pure form from waste compound semiconductors. To purify the indium feed, three methods are commonly used and they are electrolysis, vacuum distillation and zoning.

The metallic indium obtained by electrolysis or vacuum distillation is about 99.99% pure and contains at least 0.5 ppm each of impurities such as Si, Fe, Ni, Cu, Ga and Pb. The purification from waste compound semiconductors has the problem that large equipment and prolonged time are needed to separate and recover indium.

In the zone purification method, the purified indium mass has to be cut and there is a potential hazard of contamination; hence, the purification process inevitably suffers from a limited throughput and a lowered yield. In addition, when the purified indium is cast into an ingot, impurities may enter during casting to cause contamination.

With a view to solving these problems, researchers of Dowa Mining Co., Ltd. of Tokyo, Japan, including one of the present inventors, previously developed an improved technology for purifying indium to a purity of at least 99.9999% by vacuum distillation and proposed it in Japanese Patent Application No. 8-294430 (now matured into JP 10-121163A, hereinafter referred to as "JP-163"). As it turned out, this technology had the problem that purification became more difficult as the difference between the vapor pressures of the metal of interest and impurity elements decreased. Hence, it was desired to develop a purification technology that was capable of producing indium of higher purity with higher efficiency and which was also applicable to the similar metals mentioned above.

The purifying method of JP-163 could be carried out with no problems when it was practiced in a laboratory scale for a relatively short time period. However, the inventors encountered a lot of trouble when they conducted tests of a longer duration. Hence, they recognized that it would be difficult to carry out the method of JP-163 continuously for a very long time period, particularly when it should be conducted in a commercialized scale.

One of the problems was that the production of 6N-purity indium could not be maintained for a long period because of causing an abnormal increase in the Si content of the final product.

Another problem was that the outer quartz cylinder 20 (see FIG. 2) was distorted or deformed when it was heated to a high temperature for a long period.

A further problem was that an unknown white powdered material was formed in the inner quartz cylinder 21 (see FIG. 2) when subjected to an enhanced temperature for a prolonged time and it accumulated on top of the purified indium collected in the recovery mold 23.

In order to solve the problems mentioned above, the inventors conducted intensive studies and finally succeeded in solving all of them. After repeating a lot of trials and errors, the inventors solved the problems one by one and finally attained the present invention.

As regards the first problem, it was considered that at an enhanced temperature, vaporized indium attacked the inner wall of the quartz cylinder and when the temperature became too high, deterioration of the quartz cylinder occurred and recontamination of the purified indium took place. To avoid the reaction of indium vapor and the quartz cylinder, the inventors decided to use an inner tube made of graphite, instead of the quartz inner cylinder. As a result, they were successful in stabilizing the purifying temperature and highly improving the rate of purification, as compared with the method of JP-163.

The second problem came from the softening of the quartz by heat and the pressure applied thereon due to the pressure difference between the outside (air) and the inside (vacuum) atmospheres of the outer quartz cylinder 20. Accordingly, it seemed necessary to drastically change the structure of the purifying apparatus. Hereupon, in order to prevent the outer quartz cylinder 20 from softening and deforming under high temperatures and the pressure difference between air and high vacuum atmospheres, it was found necessary to make a quartz cylinder having a very thick wall. It turned out to be very expensive to make a large scale purifying apparatus of a quartz cylinder having such a thick wall. Moreover, such a big apparatus would be difficult to handle because of increased weight. In addition, it turned out that even if the second problem was solved by construction of a thick wall outer quartz cylinder, the above-described first problem could not be solved.

Hereupon, the present inventors gave up using an outer quartz cylinder and instead made a new purifying apparatus having a rigid shell (also serving as an outer tube) that would not be deformed due to the pressure difference under a high temperature condition. The inside of applicants' furnace is entirely a vacuum, and heaters are provided fixed to the inner wall of the rigid shell which serves as an outer tube of a purifying apparatus. These heaters (6 and 7 in FIG. 1) can directly heat the inner graphite tube (3 in FIG. 1) and its whole contents.

As regards a third problem, the inventors considered that the white powdered material was produced by the reaction of vaporized indium and the inner wall of the quartz cylinder 21. It was confirmed by X-ray diffraction analysis that the white powdered material was a mixture of In and $SiO_2$.

Thus, according to the present invention, the reconstruction of a purifying apparatus was made by integration of the electric furnace 18 (shown in FIG. 2), the outer quartz cylinder 20 (shown in FIG. 2), the inner quartz cylinder 21 (shown in FIG. 2) together with all the other members contained therein into a one-body assembly. Namely, in the purifying apparatus of the present invention, upper heaters 6 and lower heaters 7 are installed in a vacuum atmosphere between the outer tube 1 and the inner tube 3, each shown in FIG. 1.

By employing this structure, the problem of distortion or deformation of the outer quartz cylinder 20 due to high temperature and the pressure difference discussed herein-above were solved. In the apparatus of JP-163, the electric furnace 18 (see FIG. 2) was separately used by placing it surrounding the quartz outer cylinder 20, and heat was applied by an external source (electric furnace 18) through the air atmosphere. In contrast thereto, in the apparatus of the present invention, the electric furnace and the inner tube are integrated into one body.

According to JP-163, a metal feed was heated at a temperature of 1000° C. or higher in a first thermal purification step, but no special temperature control was made for conducting a second thermal purification step. In a laboratory scale production of high purity indium, this was satisfactory from the viewpoints of both desired purity and production efficiency. Thus, no problem was recognized. In the practice of an enlarged scale, however, it was found necessary to enhance the temperature in the first thermal purification step to a range of 1100° C. to 1300° C. to obtain improved production efficiency. It was also found necessary to closely control the temperature within the range of 900° C. to 1000° C. in the second thermal purification step so as to constantly obtain the desired high purity product.

In the purifying apparatus of the present invention, heaters made of graphite are employed to avoid the reaction with indium. The positioning of in-furnace members of the purifying apparatus is made in such a manner that the assembling of all the members is made in advance at a place outside of and below, but not directly below the furnace. Then, the already assembled members are automatically moved in a horizontal direction until they reach a position directly below the furnace, where they should stand. Then the furnace is automatically lowered from an upper level position until it reaches the position where the assembled members stand, and the furnace is fixed there surrounding the already assembled in-furnace members of the purifying apparatus.

In the apparatus of the present invention, the outer periphery of the furnace is cooled with water which flows in a water jacket provided within the shell generally made of stainless steel. Therefore, the temperature drop after the finish of the purifying operation is rapid (about one half of the time in the case of air cooling). Namely, the operation time required is about one half that required in the case of JP-163. For example, in the case of water cooling, it took 4 hours before the furnace temperature reached the ordinary temperature after finishing the operation, though in the case of air cooling (as in JP-163), it took 8 hours to attain the same thing. Thus, purifying time can be greatly shortened.

As members to be used in a furnace, carbon heaters (6 and 7), carbon fiber heat-insulating material (17), as well as an inner carbon tube (3) are used in order to avoid contamination from the in-furnace member materials as much as possible. As a result of changing the heating manner from an external heating type to the in-furnace heating system, temperature-monitoring points were also changed from the points outside the outer quartz cylinder 21 in FIG. 2 to the points between the carbon heaters (6 or 7 in FIG. 1) and the inner carbon tube 3 (in FIG. 1). By this change the closer control of the purifying temperature has become possible. Moreover, in the case of the conventional furnace shown in FIG. 2, the open air entered the space surrounding the outer quartz cylinder 21, where heat convection occurred and it was difficult to make correct temperature control because of the influence of ascending current on the measuring points of thermocouples.

SUMMARY OF THE INVENTION

An object, therefore, of the present invention is to provide an enhanced purification method by which even an indium feed containing many impurity elements can be purified consistently and at high speed to a purity of 99.9999% or higher and which is also applicable to the above-mentioned similar metals to yield equally purified products.

Another object of the invention is to provide an apparatus for purification that can be used to implement the method.

The present inventors conducted intensive studies in order to attain the stated objects by a two-step process in which the indium in an indium feed was evaporated and then condensed for recovery in the first thermal purification step to be separated from impurity elements of lower vapor pressure and in which the recovered indium was then heated in the second thermal purification step to evaporate away impurity elements of higher vapor pressure. As a result, they found that not only the impurity elements having lower vapor pressure than indium, but also those having higher vapor pressure could be separated in a consistent and efficient manner to yield indium with a purity of about 99.9999% or higher. They also-found that by using graphite as the constituent material of areas which were to be contacted by indium during the purification process, in particular, the inner tube and by providing diffuser plates in the pathway of distillation in the second thermal purification step, recontamination could be prevented and the purification speed could be markedly improved. The inventors also found that this technology was applicable not only to indium, but also to other metals that could be purified by the difference in vapor pressure, in particular, the similar metals mentioned above.

DETAILED DESCRIPTION OF THE INVENTION

Figure 1:
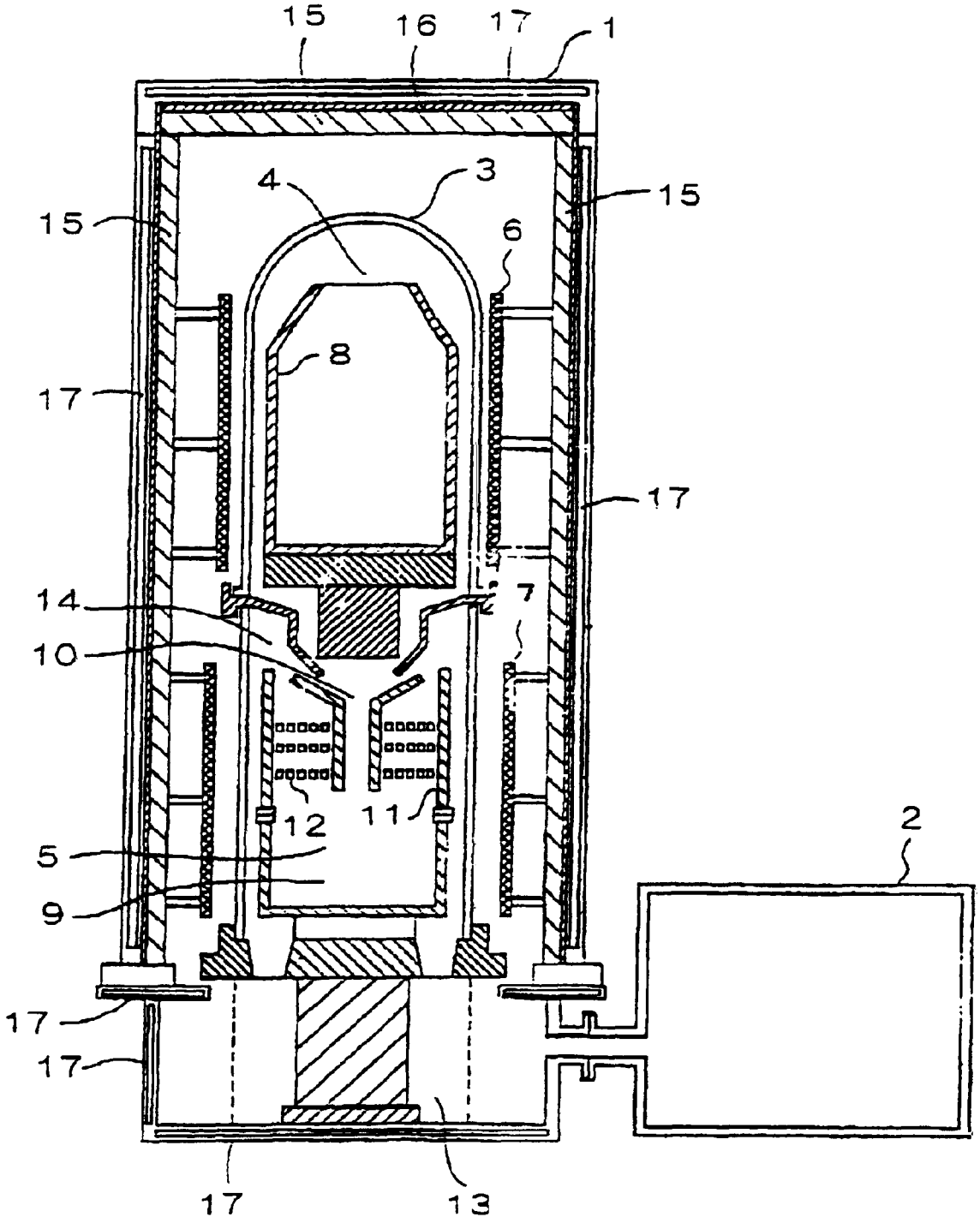
FIG. 1 is a schematic vertical section of an apparatus for purifying indium according to the present invention.

The present invention provides the following methods according to its first aspect:

1. A method of enhanced purification of high-purity metals which comprises purifying a metal feed by distillation in a vacuum atmosphere to yield the desired metal with high purity, which method further comprising a first thermal purification step in which said metal feed in a feed crucible positioned in the upper interior of an inner tube maintaining said vacuum atmosphere is heated and the generated vapor of said desired metal is brought into contact with the inner surface of said inner tube so that it is condensed and recovered in a separate form from impurity elements that have lower vapor pressure than said desired metal and which are allowed to stay within said feed crucible, and a second thermal purification step in which said desired metal as recovered is admitted into and heated in a liquid reservoir in the lower part of a tubular member positioned in the lower interior of said inner tube and the generated vapor is passed through a diffuser positioned in the upper part of said tubular member and guided by suction so that the vapors of impurity elements having higher vapor pressure than said desired metal are solidified in a separate form in a cooling trap positioned below said tubular member and the vapor of said desired metal is brought into contact with said diffuser so that it is condensed and returned to said liquid reservoir.
2. The method according to item 1, wherein said diffuser is made of a carbonaceous material.
3. The method according to item 1 or 2, wherein said liquid reservoir is a recovery mold for casting said desired metal having high purity after enhanced purification.

4. The method according to any one of items 1–3, wherein said desired metal is indium, said metal feed is heated at 1100 to 1300 ° C. in the first thermal purification step and said desired metal as recovered is heated at 900 to 1200° C. in the second thermal purification step.
5. The method according to any one of items 1–3, wherein said desired metal is at least one metal selected from the group consisting of antimony, zinc, tellurium, magnesium, cadmium, bismuth and silver.

According to its second object, the present invention provides the following apparatus:

6. An apparatus for enhanced purification of high-purity metals, which comprises an inner tube in which a vacuum atmosphere is to be formed, a first heating chamber provided in the upper interior of said inner tube, a second heating chamber provided in the lower interior of said inner tube, said first heating chamber accommodating a feed crucible with an open top into which a metal feed is charged and the desired metal in said metal feed is evaporated for recovery while impurity elements having lower vapor pressure than said desired metal are separated by being allowed to stay within said feed crucible, said second heating chamber accommodating a tubular member having in the top an inlet for receiving said desired metal as recovered and an outlet through which impurity elements that have higher vapor pressure than said desired metal and which are evaporated in separate form upon heating are discharged, as well as a liquid reservoir for heating said desired metal which is formed in the lower part of said tubular member, and a diffuser for condensing said desired metal as evaporated which is installed across the upper part of said tubular member.
7. The apparatus according to item 6, wherein said inner tube is surrounded by an outer tube of a larger diameter that permits said vacuum atmosphere to communicate with said inner tube and which is generally concentric therewith, said apparatus further including an upper heater and a lower heater provided in the space between the inner surface of said outer tube and the outer surface of said inner tube, said upper heater being positioned in the upper part of said space to heat said feed crucible and said lower heater being positioned in the lower part of said space to heat said liquid reservoir.
8. The apparatus according to item 6 or 7, wherein said diffuser consists of a plurality of generally parallel plates, each having a plurality of holes made through it.
9. The apparatus according to any one of items 6–8, wherein at least the inner surface of the ceiling of said inner tube is domed or made conical in shape.
10. The apparatus according to any one of items 6–9, wherein said desired metal is at least one metal selected from the group consisting of indium, antimony, zinc, tellurium, magnesium, cadmium, bismuth and silver.

The present invention also concerns the following methods.

11. A method of enhanced purification of a high-purity metal which comprises purifying a metal feed by distillation in a vacuum atmosphere to yield the desired metal with high purity, said method further comprising carrying out a first thermal purification step in which said metal feed in a feed crucible positioned in an upper interior of an inner tube maintaining said vacuum atmosphere is heated and the generated vapor of said desired metal is bought into contact with an inner surface of said inner tube so that the vapor of said desired metal is condensed and recovered in a separate form from impurity elements that have a lower vapor pressure than said desired metal and which are allowed to stay within said feed crucible, and carrying out a second thermal purification step in which said desired metal as recovered is admitted into and heated in a liquid reservoir in a lower part of a tubular member positioned in a lower interior of said inner tube and the generated vapor is passed through a diffuser positioned in an upper part of said tubular member and guided by suction so that the vapor of impurity elements having a higher vapor pressure than said desired metal are solidified in a separate form in a cooling trap positioned below said tubular member and the vapor of said desired metal is brought into contact with said diffuser so that the vapor of said desired metal is condensed and returned to said liquid reservoir, said method being carried out in a purifying apparatus comprising a rigid shell outer tube that accommodates said inner tube, said outer tube having an inner wall which is entirely covered with a carbonaceous heat-insulating material and having an upper heater and a lower heater, each of said upper heater and said lower heater being made of a carbonaceous material, said inner tube, said crucible, said diffuser and any other members placed in said inner tube are also made of a carbonaceous material.
12. The method according to item 11, wherein said rigid shell is made of a stainless steel having included therein a water jacket.
13. The method according to item 11 or item 12, wherein said liquid reservoir is a recovery mold for casting said desired metal having a high purity after enhanced purification.
14. The method according to item 11 or item 12, wherein said desired metal is indium, said metal feed is heated at 1100 to 1300° C. in the first thermal purification step and said desired metal as recovered is heated at 900 to 1200° C. in the second thermal purification step.
15. The method according to item 13, wherein said desired metal is indium, said metal feed is heated at 1100 to 1300° C. in the first thermal purification step and said desired metal as recovered is heated at 900 to 1200° C. in the second thermal purification step.
16. The method according to item 14, wherein said desired metal is indium, said metal feed is heated at 1100 to 1300° C. in the first thermal purification step and said desired metal as recovered is heated at 900 to 1000° C. in the second thermal purification step.
17. The method according to item 15, wherein said desired metal is indium, said metal feed is heated at 1100 to 1300° C. in the first thermal purification step and said desired metal as recovered is heated at 900 to 1200° C. in the second thermal purification step.
18. The method according to item 11 or item 12, wherein said desired metal is at least one metal selected from the group consisting of antimony, zinc, tellurium, magnesium, cadmium, bismuth and silver.
19. The method according to item 13, wherein said desired metal is at least one metal selected from the group consisting of antimony, zinc, tellurium, magnesium, cadmium, bismuth and silver.

The present invention is also directed to the following apparatus.

20. An apparatus for enhanced purification of a high-purity metal, which comprises an inner tube in which a vacuum atmosphere is to be formed, a first heating chamber provided in an upper interior of said inner tube, a second heating chamber provided in a lower interior of said inner tube, said first heating chamber accommodating a feed crucible with an open top into which a metal feed is charged and the desired metal in said metal feed is evaporated for recovery while impurity elements having a lower vapor pressure than said desired metal are separated by being allowed to stay within said feed crucible, said second heating chamber accommodating a tubular member having in a top thereof an inlet for receiving said desired metal as recovered and an outlet through which impurity elements that have a higher vapor pressure than said desired metal and which are evaporated in separate form upon heating are discharged, as well as a liquid reservoir for heating said desired metal which is formed in a lower part of said tubular member, and a diffuser for condensing said desired metal as evaporated which is installed across an upper part of said tubular member, said purifying apparatus comprising a rigid shell outer tube of a larger diameter than said inner tube, said rigid steel outer tube being placed surrounding said inner tube that permits said vacuum atmosphere to communicate with said inner tube and which is substantially concentric therewith, said outer tube having an inner wall which is entirely covered with a carbonaceous heat-insulating material and having an upper and a lower heater, each of said upper heater and said lower heater being made of a carbonaceous material, said inner tube as well as said crucible, said diffuser and any other members placed in said inner tube are also made of a carbonaceous material.

21. The apparatus according to item 20, wherein said diffuser comprises a plurality of substantially parallel plates, each having a plurality of holes made therethrough.
22. The apparatus according to item 20 or item 21, wherein at least the inner surface of the ceiling of said inner tube is domed or has a conical shape.
23. The apparatus according to item 20 or item 21, wherein said desired metal is at lest one metal selected from the group consisting of antimony, zinc, tellurium, magnesium, cadmium, bismuth and silver.

The apparatus for enhanced purification of high-purity metals according to the invention may be designed to have a layout as shown schematically in vertical section in FIG. 1. To be more specific, the apparatus has an outer tube 1 that is composed of a stainless steel frame, water-cooled areas and heat insulators such as alumina sheets and which has its inner surfaces made of a heat-insulating carbon material. The inner space of the outer tube 1 maintains a vacuum atmosphere by means of a vacuum pump 2. A smaller-diameter graphite inner tube 3 which is generally concentric with the outer tube 1 is inserted into the latter and the inner spaces of the two tubes communicate with each other so that the inner space of the graphite inner tube 3 also maintains a vacuum atmosphere. The ceiling of the inner tube 3 preferably has at least its inner surface domed or has a conical shape. By this design, the metal of interest evaporating from within the feed crucible 8 contacts the inner surface of the ceiling of the inner tube 3 and then condenses in the form of drops deposited on the inner surface of the ceiling; the drops are pulled by surface tension to run rapidly down the inner surfaces of the sidewalls instead of just falling down from the inner surface of the ceiling of the inner tube 3 to come back into the feed crucible 8. The inner tube 3 has a first heating chamber 4 in its upper part and a second heating chamber 5 in its lower part that communicates with the first heating chamber 4. An upper carbon heater 6 for heating the first heating chamber 4 and a lower carbon heater 7 for heating the second heating chamber 5 are provided in the space between the inner surface of the outer tube 1 and the outer surface of the inner tube 3. The feed crucible 8 made of graphite is provided within the first heating chamber 4 and a tubular member 11 is provided within the second heating chamber 5; the tubular member 11 has a liquid reservoir 9 in the lower part and is open in the center and periphery of its top to be fitted with a inwardly funnel-shaped inlet 10.

Diffusers 12 are provided across the upper part of the tubular member 11 to extend from its inner surface to the funnel-shaped inlet 10. The diffusers 12 may be plates having through-holes or they may be packed layers having large voids penetrating through them. In short, while various impurity elements are evaporated by heating in the tubular member 11 to generate convecting vapors, the vapors of those impurity elements having a higher vapor pressure than indium pass through the diffusers 12 to be discharged out of the second heating chamber, whereas the vapor of indium condenses on the diffusers 12 and drips back to the liquid reservoir 9; in this way, the impurity elements having a higher vapor pressure than indium are removed. The diffusers 12 are preferably made of a material that is not highly reactive with metals and more preferably are made of graphite throughout. The required number of diffusers 12, the diameter and number of through-holes in each diffuser plate, the spacing between adjacent plates, etc. may be adjusted in accordance with the purification speed, the concentrations of impurities, the heating temperature, etc. The through-holes in each diffuser plate may be clogged by a metal solidified from a vapor state if they are too small in diameter or number. Hence, the through-holes are preferably at least 2 mm in diameter. A cooling trap 13 is provided below the inner tube 3 in the neighborhood of the suction port of the vacuum pump 2; by means of this cooling trap 13, a vacuum intake containing the vapors of impurity elements having a higher vapor pressure than indium, namely, the vapors generated in the first heating chamber, but not condensed and the vapors discharged from the second heating chamber are cooled to trap the residual vapors in separate form. In FIG. 1, there are shown carbon fiber insulating heat-insulating material 15 and a ceramic sheet, specifically an alumina sheet 16.

The term "vacuum atmosphere" as used herein means a highly evacuated state which is preferably represented by the degree of vacuum not higher than a pressure of $1\times10^{-3}$ Torr ($1.3\times10^{-1}$ Pa), more preferably a pressure in the range of from $1\times10^{-3}$ to $1\times10^{-6}$ Torr ($1.3\times10^{-1}$~$1.3\times10^{-4}$ Pa). A suitable amount of an indium feed (with a purity of about 99.99%) is charged into the feed crucible 8 in the first heating chamber 4 and heated by the upper carbon heater 6 to a temperature between 1100 to 1300° C., preferably between 1200 and 1280° C., in a vacuum atmosphere; the indium feed in the feed crucible 8 evaporates, condenses principally on the inner surfaces of the inner tube 3 and drips through the funnel-shaped inlet 10 into the liquid reservoir 9 in the lower part of the tubular member 11 in the second heating chamber 5 communicating with the lower part of the first heating chamber 4. If the pressure in the first heating chamber 4 is higher than $1\times10^{-3}$ Torr ($1.3\times10^{-1}$ Pa) or if the heating temperature is less than 1100° C., the evaporation of indium slows down to lower the rate of its purification. If the heating temperature exceeds 1300° C., the impurity elements having lower vapor pressure than indium evaporate in increasing amounts and get into the liquid reservoir 9 together with indium, making indium purification difficult to continue.

Among the various impurity elements contained in the indium feed, aluminum, silicon, iron, nickel, copper and gallium having lower vapor pressure than indium stay within the feed crucible 8. On the other hand, phosphorus, sulfur, chlorine, potassium, calcium, zinc, arsenic, cadmium and lead having higher vapor pressure than indium evaporate from within the feed crucible, condense within the first heating chamber 4 together with indium and drip through the inlet 10 to get into the liquid reservoir 9. Further purification of indium has been substantially impossible by the prior art. To overcome this difficulty, the present invention applies a special treatment to the indium recovered condensed in the liquid reservoir 9. In the second heating chamber 5, the liquid reservoir 9 is maintained at a temperature in the range of 900 to 1200° C., preferably 1050 to 1150° C., by means of the lower carbon heater 7, whereby the vapors of the impurity elements having higher vapor pressure than indium that have been generated to connect in the liquid reservoir 9 pass through the diffuser plates 12 to be discharged from the system whereas the indium vapor condenses upon contact with the diffuser plates 12 and drips again into the liquid reservoir 9. If the heating temperature in the second heating chamber is less than 900° C., the evaporation of the impurities to be removed slows down; if the heating temperature exceeds 1200° C., the evaporation of indium increases abruptly. As will be described later in Comparative Example 1, even if the diffuser plates 12 are absent from the interior of the tubular member 11, the impurity elements having a higher vapor pressure than indium evaporate from the recovered indium mass in the liquid reservoir 9 and can be removed to some extent. However, by installing the diffuser plates 12 across the upper part of the tubular member 11, evaporation, convection and condensation of indium are effectively performed so that not only the surface layer of the recovered indium mass in the liquid reservoir 9, but also its entire bulk is circulated, whereby the impurity elements having higher vapor pressure are evaporated from the entire part of the recovered indium mass to achieve higher yield in purification. Above all, the indium which evaporates accompanying the impurity elements having higher vapor pressure can be recondensed on the diffuser plates 12 so that the loss of the recovered indium mass from the liquid reservoir 9 that can occur during the purification process is suppressed to a minimum industrially feasible level.

In the present invention, the shape of the inner surface of the liquid reservoir 9 is designed to be the same as that of a recovery mold which is to be used in the step subsequent to the first and second thermal purification steps (herein referred to as "after enhanced purification"). This eliminates the need of the prior art technology for remelting the purified indium to be cast into an ingot and recontamination by the casting operation is effectively prevented to yield satisfactorily purified indium. Conventionally, quartz is often used as the refractory material of the inner tube 3; in the present invention, the inner tube 3 and the diffuser plates 12 are preferably made of graphite and, more preferably, substantially all surfaces that are to be contacted by indium in a gaseous and a liquid form in a vacuum atmosphere, particularly at least the inner surfaces of the inner tube 3, the upper heater 6, the lower heater 7, the diffuser plates 12 and the like are made of high-purity graphite in order to prevent indium contamination. The shift from quartz to graphite as the constituent material of the inner tube 3 has the added advantage that the temperature the inner tube 3 can withstand and, hence, the heating temperature in it can be elevated to increase the rate of indium purification. What is more, the thermal conductivity of the inner tube 3 is also increased. Thus, as will be described later in Example 2, the rate of condensation and, hence, the rate of indium purification can be increased given the same heating temperature. A comparative test was performed to determine the rate of indium purification at 1150° C., 1250° C. and 1300° C. using two types of inner tube 3, one being made of graphite and the other made of quartz. As shown in Table 2 (see Example 2 and Comparative Example 2), the rate of indium purification was 2.95 g/min (graphite) and 0.8 g/min (quartz) at 1150° C., 10.4 g/min (graphite) and 8.7 g/min (quartz) at 1250° C., and 15.2 g/min (graphite) and 13.3 g/min (quartz).

The indium thus obtained by enhanced purification was analyzed with a glow discharge mass spectrometer and the total of the impurities present was no more than 1 ppm. To determine the purity of indium, the impurity elements to be measured are subjected to quantitative analysis with a glow discharge mass spectrometer and the total sum of the impurity contents is subtracted from 100%.

It should be noted that the method and apparatus for enhanced purification of the invention are applicable not only to indium, but also to all other metals that can be purified by the difference in vapor pressure, as exemplified by antimony, zinc, tellurium, magnesium, cadmium, bismuth and silver.

The present invention is further illustrated by reference to the following examples which are by no means intended to limit the scope of the invention.

EXAMPLE 1

FIG. 1 is a schematic vertical section of the apparatus used in the examples to perform enhanced purification of indium. It had a graphite inner tube 3 containing a graphite feed crucible 8 in its upper part and a graphite tubular member 11 in the lower part. The tubular member 11 had in its open top a funnel-shaped inlet 10 through which indium would drip into the second heating chamber 5 in the tubular member 11 after condensing in the first heating chamber 4. The lower part of the tubular member 11 was the liquid reservoir 9 and the upper periphery of the tubular member 11 was open to serve as an outlet through which to discharge the vapors of the impurity elements having higher vapor pressure which evaporated from the recovered indium mass in the liquid reservoir 9. In the upper part of the tubular member 11, graphite diffuser plates 12 were installed between the inner surface of the tubular member 11 and the outer surface of the funnel-shaped inlet 10. The diffuser plates 12 were detachable to facilitate the removal of deposits and replacement after use. An outer tube 1 generally concentric with the inner tube 3 was slipped over it and carbon heaters 6 and 7 were installed in the upper and lower parts, respectively, of the space between the inner and outer tubes.

Seven kilograms of a metallic indium feed having the assay shown in Table 1 hereinbelow was charged into the feed crucible 8 and the interior of the crucible was evacuated through the outer tube 1 and the inner tube 3 by means of a vacuum pump 2 so that the degree of vacuum in the crucible was at a pressure of $1\times10^{-4}$ Torr ($1.3\times10^{-2}$ Pa). At the same time, the metallic indium feed was heated to 1250° C. with the upper carbon heater 6 so as to evaporate indium and the impurity elements having a higher vapor pressure. As a result of this first thermal purification step, the evaporating indium condensed upon contact with the inner surfaces of the inner tube 3 and dripped through the funnel-shaped inlet 10 to be recovered in the liquid reservoir 9 in the lower part of the tubular member 11.

Part of the impurity elements having a higher vapor pressure than indium did not condense, but remained in a vapor phase and were aspirated by the vacuum pump 2 so that it passed through an intake port 14 to solidify in a cooling trap 13 provided below the inner tube 3 in the neighborhood of the suction port of the vacuum pump 2. The solidified product was mainly composed of indium, with the remainder consisting of phosphorus, sulfur, chlorine, lead and other impurity elements having a higher vapor pressure than indium. The residue in the feed crucible 8 was chiefly composed of indium, with the remainder consisting of highly concentrated silicon, iron, nickel, copper, gallium and other impurity elements having lower vapor pressure than indium.

Since the recovered indium mass in the tubular member 1 contained part of the impurity elements having higher vapor pressure than indium, the second thermal purification step was performed to remove such impurity elements. To this end, the recovered indium mass in the liquid reservoir 9 was heated to 1100° C. by the lower carbon heater 7 and the generated convecting vapors of the impurity elements having a higher vapor pressure than indium were passed through the graphite diffuser plates 12 to be discharged from the system, whereas the indium vapor was recondensed by contact with the graphite diffuser plates 12 so that it was recovered as purified indium. By a 7-hour purification procedure, purified indium was obtained in an amount of 6 kg and analyzed to give the result shown in Table 1 (see the data for Example 1). The result of analysis for Comparative Example 1 is also shown in Table 1.

TABLE 1

Analyses of impurities in the indium feed and the purified indium (by glow discharge mass spectrometer; unit, ppm)

| | F | P | Si | S | Cl | Fe |
|---|---|---|---|---|---|---|
| Feed | 0.24 | 0.01 | 0.14 | 0.02 | 0.45 | 0.15 |
| Example 1 | <0.01 | <0.01 | 0.03 | <0.01 | 0.01 | <0.01 |
| Comparative Example 1 | <0.01 | <0.01 | 0.12 | <0.01 | 0.01 | <0.01 |

| | Ni | Cu | Ga | Sb | Pb |
|---|---|---|---|---|---|
| Feed | 2.3 | 0.28 | 0.03 | 0.02 | 0.2 |
| Example 1 | <0.01 | <0.01 | <0.01 | <0.01 | 0.01 |
| Comparative Example 1 | <0.01 | <0.01 | 0.03 | 0.01 | 0.13 |

Comparative Example 1

For comparison with Example 1, indium was purified by repeating the procedure of Example 1 except that the diffuser plates 12 were omitted and the result of analysis of the purified product is shown in Table 1 (see the data for Comparative Example 1). Without diffuser plates, indium purification could at least be accomplished; however, it was only the surface layer of the recovered indium mass in the liquid reservoir 9 that was principally purified and compared to Example 1 in which all of the recovered indium mass in the liquid reservoir 9 was purified, the performance in removing the impurities was limited and the difference was particularly noticeable for lead and other impurity elements having close enough vapor pressures to indium. What is more, in Comparative Example 1, the indium vapor coming from the recovered indium mass in the liquid reservoir 9 in the lower part of the tubular member 11 could not be condensed again for recovery and the indium loss was so great that an industrially applicable indium purification was difficult to perform.

EXAMPLE 2

Twenty kilograms of 99.99% pure metallic indium feed was charged into the feed crucible 8 and subjected to the same purification procedure as in Example 1, except that the heating temperature in the first thermal purification step was varied at 1150° C., 1250° C. and 1300° C. and that the duration of the second thermal purification step was 15 hours. In each of the three test runs, indium could be purified to a purity of at least 99.9999%. The respective rates of indium purification are shown in Table 2 below together with the result of Comparative Example 2.

TABLE 2

| | Rates of indium purification | |
|---|---|---|
| Temperature | Example 2 | Comparative Example 2 |
| 1150° C. | 2.95 g/min | 0.8 g/min |
| 1250° C. | 10.4 g/min | 8.7 g/min |
| 1300° C. | 15.2 g/min | 13.3 g/min |

Comparative Example 2

For comparison with Example 2, purification tests were conducted under the same conditions as in Example 2 by the method described in Example 1 of Japanese Patent Application No. 8-294430. The rates of indium purification that could be achieved are shown in Table 2 (see the data for Comparative Example 2). In Comparative Example 2, the contents of impurities, particularly those having a higher vapor pressure than indium, were higher than in Example 1 but it was at least possible to produce indium having a purity of 99.9999% and more. However, the use of the quartz inner tube in Comparative Example 2 caused contamination by silicon and, in addition, due to the poor thermal conductivity of quartz, the indium vapor condensed so slowly that this was a rate-limiting factor in the purification process to realize only a slow rate of indium purification.

Comparative Example 3

Figure 2:
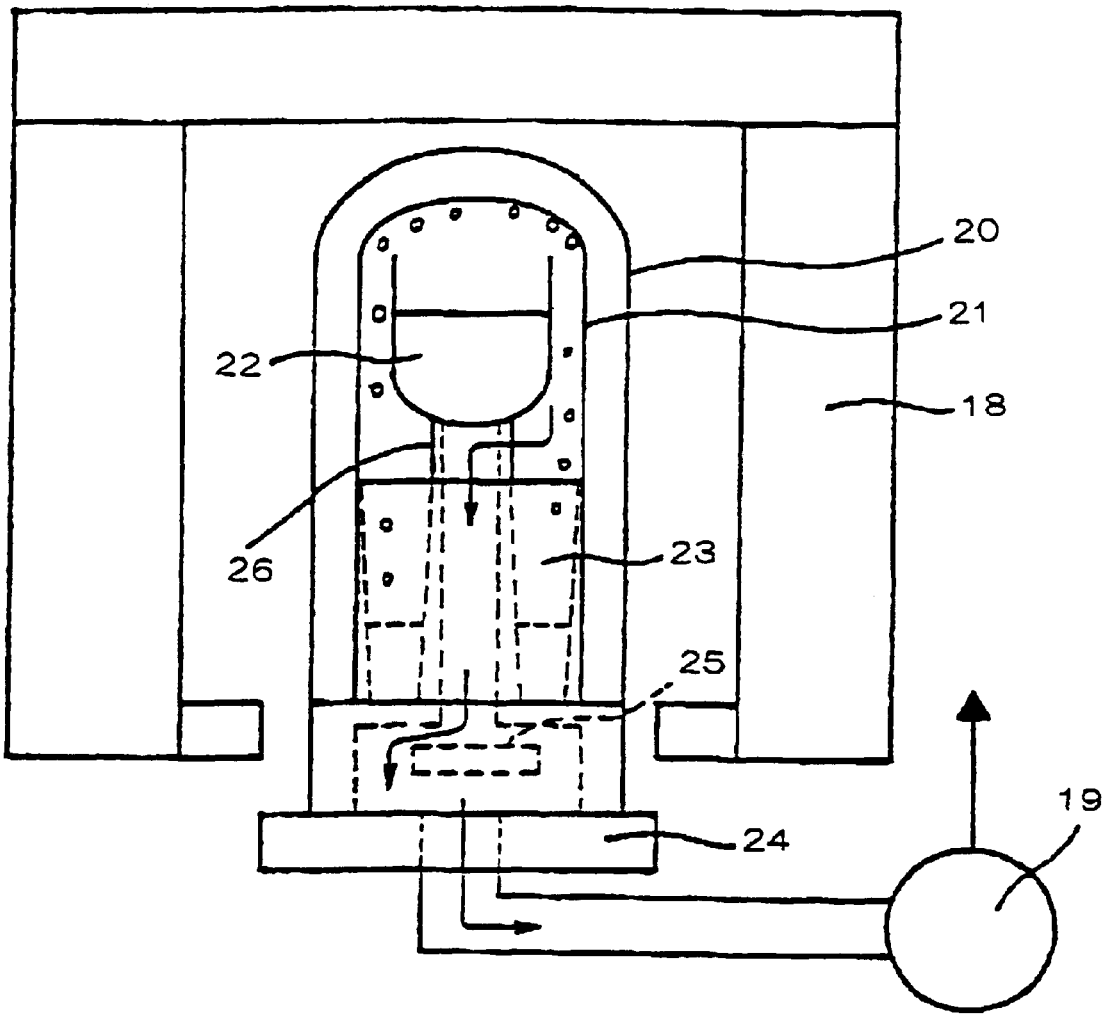
FIG. 2 prior art
FIG. 2 is a schematic vertical section of an apparatus for purifying indium according to the prior art (JP-163).

Placing 100 grams of 99.99% (4N)purity indium in a crucible 22 shown in FIG. 2, the method of JP-163 was carried out. Heating was conducted in such a manner that it took 3 hours until the temperature reached 1250° C. and this temperature was maintained for a period of ten minutes. The total heating time was three hours and ten minutes. With no problems approximately 85 grams of 99.9999% (6N) or more purity indium was obtained.

However, when the method was repeated under the same conditions as in the above case except that 2000 grams rather than 100 grams of 4N purity indium (raw material) as placed in the crucible 22 and a prolonged purifying time of 3 hours and 15 minutes was used rather than ten minutes as in the above-mentioned case (i.e., 6 hours and 15 minutes in total), the following problems were found.

First, the production of 6N-purity indium could not be maintained for a long period. An abnormal increase in the Si content was observed in the final product. Second, deformation of the outer quartz cylinder 20 was observed. Third, an unknown white powdered material was found formed in the inner quartz cylinder 21 and accumulated on top of the purified indium collected in the recovery mold 23. The quartz outer cylinder 20 shown in FIG. 2 was significantly deformed. The purifying apparatus of the present invention shown in FIG. 1 was entirely free from distortion or deformation.

EXAMPLE 3

According to the present invention, 20 kilograms of 4N-purity indium as raw material was placed in a graphite crucible 8 shown in FIG. 1 and heating was conducted in such a manner that it took 2 hours until the temperature reached 1250° C. and this temperature was maintained for a period of 30 hours and 52 minutes. Namely, the total heating time was 32 hours and 52 minutes. Moreover, after finishing the purifying operation both upper and lower heating zones in the furnace were maintained at a temperature of 1100° C. for a period of approximately 4 hours. Thus, in total heating was substantially continued for a period of 35 hours. In the second purifying step, the temperature was maintained at from 900° C. to 1000° C. Approximately 16.5 kilograms of 6N-purity indium was obtained without any trouble.

The contents of the following thirty two designated impurities shown in Table 3 were determined by GDMS (glow discharge mass spectorometer).

The contents of only Al and Si were determined to be 0.01 ppm and 0.03 ppm, respectively. The content of each of all the other impurities was found to be less than 0.01 ppm (detection limit). Thus, the total amount of all the designated impurities was determined to be 0.04 ppm. When the total amount of all the designated impurities is confirmed to be less than 1 ppm, we determine that the purity of this metal is "99.9999% or more". The purity of refined indium was determined to be 99.9999% or more.

TABLE 3

| | 1 | 2 | 3 | 4 | 5 | 6 | 7 | 8 | 9 | 10 | 11 | 12 | 13 |
|---|---|---|---|---|---|---|---|---|---|---|---|---|---|
| | B | F | Na | Mg | Al | Si | P | S | Cl | K | Ca | Ti | Cr |
| 6N-In | <0.01 | <0.01 | <0.01 | <0.01 | 0.01 | 0.03 | <0.01 | <0.01 | <0.01 | <0.01 | <0.01 | <0.01 | <0.01 |
| 14 | 15 | 16 | 17 | 18 | 19 | 20 | 21 | 22 | 23 | 24 | 25 | 26 | 27 |
| Mn | Fe | Co | Ni | Cu | Zn | Ga | As | Se | Ag | Cd | Sn | Sb | Te |
| <0.01 | <0.01 | <0.01 | <0.01 | <0.01 | <0.01 | <0.01 | <0.01 | <0.01 | <0.01 | <0.01 | <0.01 | <0.01 | <0.01 |
| | | | 28 | 29 | 30 | 31 | 32 | | | | | | |
| | | | Au | Hg | Tl | Pb | Bi | Total amount of impurities (ppm) | | | Purity of In (%) | | |
| | | | <0.1 | <0.01 | <0.01 | <0.01 | <0.01 | 0.04 | | | 99.9999% or more | | |

According to the present invention, not only impurity elements having a lower vapor pressure than indium, but also those having a higher vapor pressure can be positively separated from indium, so high-purity indium with a purity of about 99.9999% or more can consistently be obtained with the additional advantage of preventing the loss of indium that may occur during its purification.

If desired, at least part, preferably all, of the inner surfaces of the purifying apparatus which are to be contacted by indium may in effect be formed of high-purity graphite and this contributes to preventing contamination by the constituent material of the apparatus. If necessary, the liquid reservoir 9 may be an indium recovery mold and this is effective in preventing recontamination that may occur during the steps of purifying and casting indium. Conventionally, the inner tube has been made of quartz but quartz has low softening point and reacts with indium at elevated temperatures. By forming the inner tube of graphite, the problem of contamination is resolved and, what is more, the heat resistance and thermal conductivity of the inner tube are so much increased that the indium purification temperature and rate are sufficiently increased to achieve a remarkable improvement in productivity.

In addition to indium, the similar metals such as antimony, zinc, tellurium, magnesium, cadmium, bismuth and silver can be purified by the method of the invention relying upon the difference in vapor pressure and equally good results are obtained with these metals.

If a vacuum atmosphere is created in the outer tube as well as in the inner tube, the following advantages are obtained: (1) sufficient heat insulation is provided to save the cost of energy; (2) the problem of the heat capacity and convection around the heaters is resolved to permit easy control of the temperature in the heating chambers; and (3) the oxidative corrosion of the heaters is significantly reduced.

It was confirmed that by changing the degree of vacuum in the furnace, and the temperatures in the first and second thermal purification steps, the method and the apparatus of the present invention can be used advantageously for achieving an enhanced purification of 3N–4N purity metals of antimony, zinc, tellurium, magnesium, cadmium, bismuth, silver, etc., to a higher grade product of 5N–6N purity metals.

The apparatus of JP-163 could also be used for the same purpose. However, in addition to the problems already mentioned, there were also the following problems when the apparatus of JP-163 was used.

When silver was to be purified, devitrification of quartz took place at an elevated temperature. This became a cause of contamination of a high purity metal by $SiO_2$. When metals such as zinc and manganese were to be purified, they adhered to quartz when their vapor was in contact with a quartz wall. After the purifying operation, when one tried to remove the adhered materials, flaking of the quartz occurred. All of these problems could be solved by the present invention. The present invention will be further illustrated by the following Examples.

EXAMPLE 4

Five kilograms of 99.99% pure metallic antimony feed was charged into the feed crucible 8 and subjected to the same purification procedures as in Example 1, except that the degree of vacuum in the crucible was at a pressure of $5\times10^{-3}$ Torr, the heating temperature in the first thermal purification step was set at 730° C., the heating temperature in the second thermal purification step was set at 620° C., and that the duration of the thermal purification treatment was 5 hours and 50 minutes. 3.5 kilograms of 99.9999% or more purity antimony was obtained. The purity of the produced antimony was determined by means of Glow Discharge Mass Spectrometry.

The contents of twenty four designated impurities shown in Table 4 were determined by GDMS. The contents of all the designated impurities except for S and Cl were found to be less than the detection limit. Thus, the total amount of all the designated impurities was determined to be 0.04 ppm. The purity of antimony was determined to be 99.9999% or more.

TABLE 4

| | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| | F | Na | Mg | Al | Si | S | Cl | K | Ca | Cr | Fe | Ni | Cu | Zn |
| 6N-Sb | <0.01 | <0.01 | <0.01 | <0.01 | <0.01 | 0.01 | 0.03 | <0.01 | <0.01 | <0.01 | <0.01 | <0.01 | <0.01 | <0.01 |

| 15 | 16 | 17 | 18 | 19 | 20 | 21 | 22 | 23 | 24 | | |
|---|---|---|---|---|---|---|---|---|---|---|---|
| As | Se | Ag | Cd | Sn | Sb | Te | Tl | Pb | Bi | Total amount of impurities (ppm | Purity of Sb (%) |
| <0.01 | <0.01 | <0.01 | <0.05 | <0.01 | <0.01 | <0.01 | <0.01 | <0.01 | <0.01 | 0.04 | 99.9999% or more |

EXAMPLE 5

Five kilograms of 99.99% pure metallic zinc feed was charged into the feed crucible 8 and subjected to the same purification procedures as in Example 4, except that the heating temperature in the first thermal purification step was set at 620° C., the heating temperature in the second thermal purification step was set at 450° C., and that the duration of the thermal purification treatment was 3 hours and 55 minutes. 3.85 kilograms of 99.9999% or more purity zinc was obtained.

The contents of twenty five designated impurities shown in Table 5 were determined by GDMS. The content each of all the designated impurities was found to be less than the detection limit. Thus, the total amount of all the designated impurities was determined to be 0.00 ppm. The purity of zinc was determined to be 99.9999% or more.

TABLE 5

| | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| | Li | B | F | Na | Mg | Al | Si | S | Cl | K | Ca | Cr | Fe | Ni |
| 6N-Zn | <0.01 | <0.01 | <0.01 | <0.01 | <0.01 | <0.01 | <0.01 | <0.01 | <0.01 | <0.01 | <0.01 | <0.01 | <0.01 | <0.01 |

| 15 | 16 | 17 | 18 | 19 | 20 | 21 | 22 | 23 | 24 | 25 | | |
|---|---|---|---|---|---|---|---|---|---|---|---|---|
| Cu | Se | Ag | Cd | In | Sn | Sb | Te | Tl | Pb | Bi | Total amount of impurities (ppm) | Purity of Zn (%) |
| <0.05 | <0.05 | <0.05 | <0.05 | <0.01 | <0.01 | <0.01 | <0.01 | <0.01 | <0.01 | <0.01 | 0.00 | 99.9999% or more |

EXAMPLE 6

Five kilograms of 99.99% pure metallic tellurium feed was charged into the feed crucible 8 and subjected to the same purification procedures as in Example 4, except that the heating temperature in the first thermal purification step was set at 600° C., the heating temperature in the second thermal purification step was set at 460° C., and that the duration of the thermal purification treatment was 3 hours and 35 minutes. 3.25 kilograms of 99.9999% or more purity tellurium was obtained.

The contents of twenty four designated impurities shown in Table 6 were determined by GDMS. The content each of all the designated impurities except for Al, Si, S, Cl and K was found to be less than the detection limit. Thus, the total amount of all the designated impurities was determined to be 0.19 ppm. The purity of tellurium was determined to be 99.9999% or more.

TABLE 6

| | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| | B | F | Na | Mg | Al | Si | S | Cl | K | Ca | Cr | Mn | Fe | Ni |
| 6N-Te | <0.01 | <0.01 | <0.01 | <0.01 | 0.05 | 0.05 | 0.01 | 0.06 | 0.02 | <0.01 | <0.01 | <0.01 | <0.01 | <0.01 |

| 15 | 16 | 17 | 18 | 19 | 20 | 21 | 22 | 22 | 23 | | |
|---|---|---|---|---|---|---|---|---|---|---|---|
| Co | Cu | Zn | Se | Ag | Cd | Sn | Sb | Pb | Bi | Total amount of impurities (ppm | Purity of Te (%) |
| <0.01 | <0.01 | <0.01 | <0.01 | <0.01 | <0.05 | <0.01 | <0.01 | <0.01 | <0.01 | 0.19 | 99.9999% or more |

EXAMPLE 7

One kilogram of 99.9% pure metallic magnesium feed was charged into the feed crucible 8 and subjected to the same purification procedures as in Example 4, except that the heating temperature in the first thermal purification step was set at 750° C., the heating temperature in the second thermal purification step was set at 660° C., and that the duration of the thermal purification treatment was 1 hour and 10 minutes. 0.7 kilograms of 99.999% or more purity magnesium was obtained.

The contents of twenty one designated impurities shown in Table 7 were determined by GDMS. The content of each of all the designated impurities except for Al, Si, P, Ca, Mn and Pb was found to be less than the detection limit. Thus, the total amount of all the designated impurities was determined to be 0.24 ppm. The purity of magnesium was determined to be 99.9999% or more.

TABLE 7

| | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| | F | Na | Al | Si | P | S | Cl | K | Ca | Cr | Mn | Fe | Ni | Cu |
| 6N-Mg | <0.01 | <0.01 | 0.01 | 0.09 | 0.01 | <0.01 | <0.01 | <0.01 | 0.07 | <0.01 | 0.02 | <0.01 | <0.01 | <0.01 |

| 15 | 16 | 17 | 18 | 19 | 20 | 21 | | |
|---|---|---|---|---|---|---|---|---|
| As | Ag | Sn | Sb | Te | Ti | Pb | Total amount of impurities (ppm) | Purity of Mg(%) |
| <0.01 | <0.01 | <0.01 | <0.01 | <0.01 | 0.04 | 0.24 | 99.9999% or more | |

EXAMPLE 8

Five kilograms of 99.99% pure metallic cadmium feed was charged into the feed crucible 8 and subjected to the same purification procedures as in Example 4, except that the heating temperature in the first thermal purification step was set at 450° C., the heating temperature in the second thermal purification step was set at 350° C., and that the duration of the thermal purification treatment was 3 hours and 15 minutes. 3.5 kilograms of 99.9999% or more purity cadmium was obtained.

The contents of sixteen designated impurities shown in Table 8 were determined by GDMS. The contents of all the designated impurities except for Cl were found to be less than the detection limit. Thus, the total amount of all the designated impurities was determined to be 0.01 ppm. The purity of cadmium was determined to be 99.9999% or more.

TABLE 8

| | 1 | 2 | 3 | 4 | 5 | 6 | 7 | 8 | 9 |
|---|---|---|---|---|---|---|---|---|---|
| | Na | Al | Si | S | Cl | K | Ca | Cr | Fe |
| 6N-Cd | <0.01 | <0.01 | <0.01 | <0.01 | 0.01 | <0.01 | <0.01 | <0.01 | <0.01 |

| 10 | 11 | 12 | 13 | 14 | 15 | 16 | | |
|---|---|---|---|---|---|---|---|---|
| Ni | Cu | Zn | As | Ti | Pb | Bi | Total amount of impurities (ppm) | Purity of Cd(%) |
| <0.01 | <0.01 | <0.01 | <0.01 | <0.01 | <0.01 | <0.01 | 0.01 | 99.9999% or more |

EXAMPLE 9

Five kilograms of 99.99% pure metallic bismuth feed was charged into the feed crucible 8 and subjected to the same purification procedures as in Example 4, except that the degree of vacuum in the crucible was at a pressure of $3\times10^{-4}$ Torr, the heating temperature in the first thermal purification step was set at 750° C., the heating temperature in the second thermal purification step was set at 350° C., and that the duration of the thermal purification treatment was 14 hours and 10 minutes. 3.5 kilograms of 99.9999% or more purity bismuth was obtained.

The contents of thirteen designated impurities shown in Table 9 were determined by GDMS. The content of each of all the designated impurities except for S, Cl and Pb was found to be less than the detection limit. Thus, the total amount of all the designated impurities was determined to be 0.15 ppm. The purity of Bi was determined to be 99.9999% or more.

TABLE 9

| | 1 | 2 | 3 | 4 | 5 | 6 | 7 | 8 | 9 | 10 | 11 | 12 | 13 | | |
|---|---|---|---|---|---|---|---|---|---|---|---|---|---|---|---|
| | Na | Al | Si | S | Cl | Cr | Fe | Ni | Cu | Zn | Ag | Te | Pb | Total Amount of | Purity of Bi (%) |
| 6N-Bi | 0.01 | <0.01 | <0.01 | 0.07 | 0.02 | <0.01 | <0.01 | <0.01 | <0.01 | <0.01 | <0.01 | <0.01 | 0.05 | 0.15 | 99.9999% or more |

EXAMPLE 10

Five kilograms of 99.99% pure metallic silver feed was charged into the feed crucible 8 and subjected to the same purification procedures as in Example 4, except that the degree of vacuum in the crucible was at a pressure of $3\times10^{-4}$ Torr, the heating temperature in the first thermal purification step was set at 1250° C., the heating temperature in the second thermal purification step was set at 1000° C., and that the duration of the thermal purification treatment was 28 hours and 20 minutes. 3.75 kilograms of 99.9999% or more purity silver was obtained.

The contents of nineteen designated impurities shown in Table 10 were determined by GDMS. The content each of all the designated impurities except for Al, Si, S, Cr, Fe, Ni and Cu was found to be less than the detection limit. Thus, the total amount of all the designated impurities was determined to be 0.27 ppm. The purity of Ag was determined to be 99.9999% or more.

TABLE 10

| | 1 | 2 | 3 | 4 | 5 | 6 | 7 | 8 | 9 | 10 | 11 | 12 |
|---|---|---|---|---|---|---|---|---|---|---|---|---|
| | Na | Mg | Al | Si | S | Cl | Ca | Cr | Fe | Ni | Cu | Zn |
| 6N-Ag | <0.01 | <0.01 | 0.02 | 0.06 | 0.04 | <0.01 | <0.01 | 0.03 | 0.08 | 0.02 | 0.02 | <0.01 |
| 13 | 14 | 15 | 13 | | 14 | 18 | 19 | | | | | |
| As | Pd | Cd | Au | | Ti | Pb | Bi | Total amount of impurities (ppm) | | | Purity of Ag (%) | |
| <0.1 | <0.1 | <0.1 | <0.1 | | <0.01 | <0.01 | <0.01 | 0.27 | | | 99.9999% or more | |

What is claimed is:

1. A method of enhanced purification of a high-purity metal by purifying a metal feed by distillation in a vacuum atmosphere to yield a desired metal with high purity, said method comprising carrying out a first thermal purification step in which said metal feed in a feed crucible positioned in an upper interior of an inner tube maintaining said vacuum atmosphere is heated and the generated vapor of said desired metal is brought into contact with an inner surface of said inner tube so that the vapor of said desired metal is condensed and recovered in a separate form from impurity elements that have a lower vapor pressure than said desired metal and which are allowed to stay within said feed crucible, and carrying out a second thermal purification step in which said desired metal as recovered is admitted into and heated in a liquid reservoir in a lower part of a tubular member positioned in a lower interior of said inner tube and the generated vapor is passed through a diffuser positioned in an upper part of said tubular member and guided by suction so that the vapor of impurity elements having a higher vapor pressure than said desired metal are solidified in a separate form in a cooling trap positioned below said tubular member and the vapor of said desired metal is brought into contact with said diffuser so that the vapor of said desired metal is condensed and returned to said liquid reservoir, said method being carried out in a purifying apparatus comprising a rigid shell outer tube that accommodates said inner tube, said outer tube having an inner wall which is entirely covered with a carbonaceous heat-insulating material and having an upper heater and a lower heater, each of said upper heater and said lower heater being made of a carbonaceous material, said inner tube, said crucible, said diffuser and any other members placed in said inner tube are made of a carbonaceous material.

2. The method according to claim 1, wherein said rigid shell is made of a stainless steel having included therein a water jacket.

3. The method according to claim 1 or claim 2, wherein said liquid reservoir is a recovery mold for casting said desired metal having a high purity after enhanced purification.

4. The method according to claim 1 or claim 2, wherein said desired metal is indium, said metal feed is heated at 1100 to 1300° C. in the first thermal purification step and said desired metal as recovered is heated at 900 to 1200° C. in the second thermal purification step.

5. The method according to claim 3, wherein said desired metal is indium, said metal feed is heated at 1100 to 1300° C. in the first thermal purification step and said desired metal as recovered is heated at 900 to 1200° C. in the second thermal purification step.

6. The method according to claim 4, wherein said desired metal is indium, said metal feed is heated at 1100 to 1300° C. in the first thermal purification step and said desired metal as recovered is heated at 900 to 1200° C. in the second thermal purification step.

7. The method according to claim 5, wherein said desired metal is indium, said metal feed is heated at 1100 to 1300° C. in the first thermal purification step and said desired metal as recovered is heated at 900 to 1200° C. in the second thermal purification step.

8. The method according to claim 1 or claim 2, wherein said desired metal is at least one metal selected from the group consisting of antimony, zinc, tellurium, magnesium, cadmium, bismuth and silver.

9. The method according to claim 3, wherein said desired metal is at least one metal selected from the group consisting of antimony, zinc, tellurium, magnesium, cadmium, bismuth and silver.

10. The method according to claim 1, wherein the carbonaceous heat-insulating material is graphite or carbon fiber, and the carbonaceous material is graphite.

11. An apparatus for enhanced purification of a high-purity metal, which comprises an inner tube in which a vacuum atmosphere is to be formed, a first heating chamber provided in an upper interior of said inner tube, a second heating chamber provided in a lower interior of said inner tube, said first beating chamber accommodating a feed crucible with an open top into which a metal feed is charged and a desired metal in said metal feed is evaporated for recovery while impurity elements having a lower vapor pressure than said desired metal are separated by being allowed to stay within said feed crucible, said second heating chamber accommodating a tubular member having in a top thereof an inlet for receiving said desired metal as recovered and an outlet through which impurity elements that have a higher vapor pressure than said desired metal and which are evaporated in separate form upon heating are discharged, a liquid reservoir for heating said desired metal which is formed in a lower part of said tubular member, and a diffuser for condensing said desired metal as evaporated which is installed across an upper part of said tubular member, said apparatus having a rigid shell outer tube of a larger diameter than said inner tube, said rigid steel outer tube surrounding said inner tube to permit said vacuum atmosphere to communicate with said inner tube and which is substantially concentric therewith, said outer tube having an inner wall which is entirely covered with a carbonaceous heat-insulating material and having an upper heater and a lower heater, each of said upper heater said lower heater being made of a carbonaceous material, said inner tube, said crucible, said diffuser and any other members placed in said inner tube are made of a carbonaceous material.

12. The apparatus according to claim 11, wherein said diffuser comprises a plurality of substantially parallel plates each having a plurality of holes made therethrough.

13. The apparatus according to claim 11 or claim 12, wherein at least the inner surface of the ceiling of said inner tube is domed or has a conical shape.

14. The apparatus according to claim 11, wherein the carbonaceous heat-insulating material is graphite or carbon fiber, and the carbonaceous material is graphite.

15. An apparatus for enhanced purification of a high-purity metal, which comprises an inner tube in which a vacuum atmosphere is to be formed, a first heating chamber provided in an upper interior of said inner tube, a second heating chamber provided in a lower interior of said inner tube, said first heating chamber accommodating a feed crucible with an open top into which a metal feed is charged and a desired metal in said metal feed is evaporated for recovery while impurity elements having a lower vapor pressure than said desired metal are separated by being allowed to stay within said feed crucible, said desired metal being at least one metal selected from the group consisting of antimony, zinc, tellurium, magnesium, cadmium, bismuth and silver, said second heating chamber accommodating a tubular member having in a top thereof an inlet for receiving said desired metal as recovered and an outlet through which impurity elements that have a higher vapor pressure than said desired metal and which are evaporated in separate form upon heating are discharged, a liquid reservoir for heating said desired metal which is formed in a lower part of said tubular member, and a diffuser for condensing said desired metal as evaporated which is installed across an upper part of said tubular member, said apparatus having a rigid shell outer tube of a larger diameter than said inner tube, said rigid steel outer tube surrounding said inner tube to permit said vacuum atmosphere to communicate with said inner tube and which is substantially concentric therewith, said outer tube having an inner wall which is entirely covered with a carbonaceous heat-insulating material and having an upper heater and a lower heater, each of said upper heater and said lower heater being made of a carbonaceous material, said inner tube, said crucible, said diffuser and any other members placed in said inner tube are made of a carbonaceous material.

16. An apparatus for enhanced purification of a high-purity metal, which comprises an inner tube in which a vacuum atmosphere is to be formed, a first heating chamber provided in an upper interior of said inner tube, a second heating chamber provided in a lower interior of said inner tube, said first heating chamber accommodating a feed crucible with an open top into which a metal feed is charged and a desired metal in said metal feed is evaporated for recovery while impurity elements having a lower vapor pressure than said desired metal are separated by being allowed to stay within said feed crucible, said desired metal being at least one metal selected from the group consisting of antimony, zinc, tellurium, magnesium, cadmium, bismuth and silver, said second heating chamber accommodating a tubular member having in a top thereof an inlet for receiving said desired metal as recovered and an outlet through which impurity elements that have a higher vapor pressure than said desired metal and which are evaporated in separate form upon heating are discharged, a liquid reservoir for heating said desired metal which is formed in a lower part of said tubular member, and a diffuser for condensing said desired metal as evaporated which is installed across an upper part of said tubular member, said diffuser comprising a plurality of substantially parallel plates each having a plurality of holes made therethrough, said apparatus having a rigid shell outer tube of a larger diameter than said inner tube, said rigid steel outer tube surrounding said inner tube to permit said vacuum atmosphere to communicate with said inner tube and which is substantially concentric therewith, said outer tube having an inner wall which is entirely covered with a carbonaceous heat-insulating material and having an upper heater and a lower heater, each of said upper heater and said lower heater being made of a carbonaceous material, said inner tube, said crucible, said diffuser and any other members placed in said inner tube are made of a carbonaceous material.

* * * * *